US010249928B2

(12) United States Patent
Kuroiwa

(10) Patent No.: US 10,249,928 B2
(45) Date of Patent: Apr. 2, 2019

(54) DIVIDER AND SIGNAL GENERATION SYSTEM USING THE SAME

(71) Applicant: ANRITSU CORPORATION, Kanagawa (JP)

(72) Inventor: Yoshihiro Kuroiwa, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 17 days.

(21) Appl. No.: 15/584,217

(22) Filed: May 2, 2017

(65) Prior Publication Data

US 2017/0373366 A1 Dec. 28, 2017

(30) Foreign Application Priority Data

Jun. 27, 2016 (JP) ..... 2016-126128

(51) Int. Cl.

| | |
|---|---|
| ***H01P 1/22*** | (2006.01) |
| ***H01P 5/04*** | (2006.01) |
| ***H01P 5/12*** | (2006.01) |
| ***H01P 5/16*** | (2006.01) |

(52) U.S. Cl.

CPC ..... *H01P 5/16* (2013.01); *H01P 1/222* (2013.01); *H01P 1/227* (2013.01); *H01P 5/04* (2013.01); *H01P 5/12* (2013.01)

(58) Field of Classification Search

CPC ..... H01P 5/16; H01P 5/12; H01P 5/04; H01P 1/222; H01P 1/227

USPC ..... 333/137

See application file for complete search history.

(56) References Cited

U.S. PATENT DOCUMENTS 8,941,448 B2 * 1/2015 Yu ..... H01P 5/16 333/100

2015/0116039 A1 * 4/2015 Ahmed ..... H03F 1/0233 330/295

FOREIGN PATENT DOCUMENTS

JP 2009-171420 A 7/2009

* cited by examiner

*Primary Examiner* — Robert J Pascal
*Assistant Examiner* — Kimberly E Glenn
(74) *Attorney, Agent, or Firm* — Pearne & Gordon LLP

(57) ABSTRACT

Provided is a divider capable of accurately evaluating an object to be measured without being affected by impedance of a terminal to be measured of the object to be measured, and a signal generation system. There is provided a divider including an input terminal, a plurality of output terminals, a distribution unit that distributes a high frequency signal input to the input terminal and outputs signals obtained by the distribution, and a plurality of reflected wave blocking units that are respectively connected to a plurality of distribution unit outputs and attenuate reflected waves reflected by sides of the plurality of output terminals. The distribution unit includes the plurality of distribution unit outputs and outputs the high frequency signal distributed from the plurality of distribution unit outputs. Outputs from the plurality of reflected wave blocking units are output from the plurality of output terminals.

10 Claims, 12 Drawing Sheets

DIVIDER AND SIGNAL GENERATION SYSTEM USING THE SAME

TECHNICAL FIELD

The present invention relates to a divider that deals with a high frequency signal.

BACKGROUND ART

Dividers are devices that are called power splitters, power dividers, branching devices and the like and distribute an input high frequency signal to a plurality of outputs. For example, a high frequency signal of several MHz to several tens of GHz is dealt with.

As an example of the use of the divider, the divider is used to distribute a high frequency signal, which is input to a wireless communication device, to a plurality of reception units and the like. In a field of measurement, for example, the divider is used to receive an input of an output signal of a signal generator and to distribute a high frequency signal to thereby transmit signals obtained by the distribution to a plurality of objects to be measured, respectively. For example, a divider disclosed in FIG. 1 of the following patent document is known. In addition, a configuration example of a divider of the related art is illustrated in FIG. 12.

RELATED ART DOCUMENT

Patent Document

[Patent Document 1] JP-A-2009-171420

DISCLOSURE OF THE INVENTION

Problem that the Invention is to Solve

Incidentally, in a field of measurement, for example, simultaneous measurement is performed to reduce a measurement time by inputting an output signal of a signal generator to a divider and inputting a plurality of output signals obtained by the distribution of the divider to measurement terminals of different objects to be measured or a measurement terminal of an object to be measured including a plurality of measurement terminals.

However, in simultaneous measurement performed by a plurality of measurement terminals by distribution using a divider of the related art, impedance of a certain measurement terminal or a signal input terminal changes due to impedance unconformity caused by a defective contact of another measurement terminal connected to an object to be measured, which results in the generation and interference of reflected waves. As a result, for example, a difference in signal level of 1 dB or greater occurs between a plurality of measurement signals obtained by the distribution, and thus there is a problem in that it is not possible to accurately perform the simultaneous measurement.

Consequently, the invention is contrived in view of such a problem, and an object thereof is to provide a divider capable of accurately evaluating an object to be measured without being affected by impedance of a terminal to be measured of the object to be measured, and a signal generation system.

Means for Solving the Problem

In order to accomplish the above-described object, there is provided a divider (100) according to a first aspect including an input terminal (10), a plurality of output terminals (50-1, 50-2, . . . , and **50-*n*), a distribution unit (20) that distributes a high frequency signal input to the input terminal and outputs signals obtained by the distribution; and a plurality of reflected wave blocking units (40-1, 40-2, . . . , and 40-*n*) that are respectively connected to a plurality of distribution unit outputs (30-1, 30-2, . . . , and 30-*n***) and attenuate reflected waves reflected by sides of the plurality of output terminals, wherein the distribution unit includes the plurality of distribution unit outputs and outputs the high frequency signal distributed from the plurality of distribution unit outputs, and wherein outputs from the plurality of reflected wave blocking units are output from the plurality of output terminals.

In order to accomplish the above-described object, in an divider (100) of a second aspect according to the divider of the first aspect, the plurality of reflected wave blocking units may respectively include attenuation units (60-1, 60-2, . . . , and **60-*n***) that attenuate a reflected signal.

In order to accomplish the above-described object, in the divider (100) of a third aspect according to the divider of the first aspect, each of the plurality of reflected wave blocking units may include an isolator that transmits only a unidirectional signal directed toward the plurality of output terminals from the distribution unit.

In order to accomplish the above-described object, the divider (100) of a fourth aspect according to the divider of the second aspect may further include attenuation amount adjustment units (70-1, 70-2, . . . , and **70-*n***) that are disposed between the plurality of distribution unit outputs and the plurality of output terminals and adjust amounts of attenuation of the attenuation units.

In order to accomplish the above-described object, there is provided a signal generation system (500) according to a fifth aspect including the divider according to any one of the first to fourth aspects, and a signal generator (200) that generates the high frequency signal, wherein the high frequency signal generated by the signal generator is input to the input terminal.

Advantage of the Invention

According to the invention, since reflected waves of a measurement signal generated due to impedance unconformity of any measurement terminal of an object to be measured can be blocked by a reflected wave blocking unit, influence of the generation and interference of the reflected waves on another measurement terminal is suppressed, and it is possible to reduce a difference in signal level between a plurality of measurement signals obtained by distribution. As a result, it is possible to reduce an error of a measurement result.

In addition, according to the invention, since reflected waves generated due to impedance unconformity of any measurement terminal of an object to be measured can be blocked by a reflected wave blocking unit, it is possible to suppress influence of the generation and interference of the reflected waves on an input port to which a signal generated by a signal generator is input, that is, a change in impedance which is seen from the input port, and thus it is possible to perform measurement at an accurate measurement level and to reduce an error of a measurement result.

In addition, according to the invention, a difference in signal level between a plurality of measurement signals obtained by the distribution of a distribution unit can be further suppressed by adjusting the signal levels of the plurality of measurement signals obtained by the distribution of the distribution unit by an attenuation amount adjustment unit, and thus it is possible to further reduce an error of a measurement result.

According to these effects, it is possible to accurately perform measurement in spite of the unconformity of impedance of a measurement terminal of an object to be measured.

BEST MODE FOR CARRYING OUT THE INVENTION

Hereinafter, embodiments for implementing the invention will be described in detail with reference to the accompanying drawings. Meanwhile, the invention is not limited by these embodiments, and all of other embodiments, examples, operation techniques, and the like which can be implemented by those skilled in the art on the basis of these embodiments are included in the scope of the invention.

First Embodiment

First, a configuration of a divider 100 according to the invention will be described with reference to FIG. 1.

Figure 1:
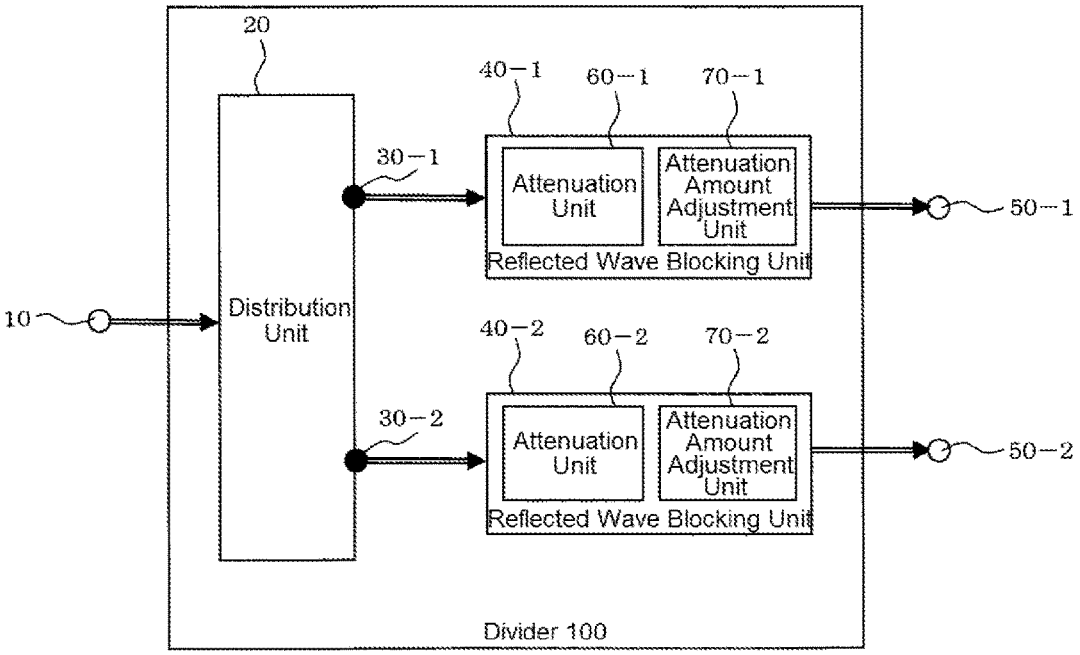
FIG. 1 is a schematic block diagram illustrating a configuration example of a divider according to the invention.

As illustrated in FIG. 1, the divider 100 of this example includes an input terminal 10, a distribution unit 20, distribution unit outputs 30-1, 30-2, . . . , and **30-*n*, reflected wave blocking units 40-1, 40-2, . . . , and 40-*n*, output terminals 50-1, 50-2, . . . , and 50-*n*, attenuation units 60-1, 60-2, . . . , and 60-*n*, and attenuation amount adjustment units 70-1, 70-2, . . . , and 70-*n*. Meanwhile, the attenuation amount adjustment units 70-1, 70-2, . . . , and 70-*n*** can also be configured to be omitted.

A high frequency signal is input to the input terminal 10 from an external signal source. Here, a high frequency signal of, for example, several MHz to several tens of GHz is dealt with. The signal source is a signal generator that generates, for example, a high frequency signal at any frequency and any signal level of any modulation system. A connector having excellent high frequency characteristics is preferably used as the input terminal 10, and is a known high frequency coaxial connector such as an N-type or SMA-type connector. Meanwhile, in this example, a description is given on the assumption that internal characteristic impedance of the divider 100 is standardized to, for example, 50Ω.

The high frequency signal from the input terminal 10 is input to the distribution unit 20, and the distribution unit performs distribution so that the level of the high frequency signal is divided into substantially equal parts and outputs the high frequency signal of the divided level to the plurality of distribution unit outputs 30-1, 30-2, . . . , and **30-*n*. The distribution unit 20** is constituted by known high frequency signal distribution means such as a 2-resistor type, a 3-resistor type, or a Wilkinson divider. Meanwhile, in general, isolation of a plurality of outputs obtained by the distribution is approximately 20 dB.

The plurality of reflected wave blocking units 40-1, 40-2, . . . , and **40-*n* are connected to the plurality of distribution unit outputs 30-1, 30-2, . . . , and 30-*n*, respectively. The plurality of reflected wave blocking units 40-1, 40-2, . . . , and 40-*n* are constituted by the attenuation units 60-1, 60-2, . . . , and 60-*n*, that is, pads using a known resistor such as a n-type attenuator or a T-type attenuator. It is preferable that the amount of attenuation is, for example, approximately 3 dB to 10 dB. Meanwhile, the plurality of distribution unit outputs 30-1, 30-2, . . . , and 30-*n* and the plurality of reflected wave blocking units 40-1, 40-2, . . . , and 40-*n* may be connected to each other, for example, by a connector having excellent high frequency characteristics. In addition, the connection may be performed by a transmission line having excellent high frequency characteristics, for example, a microstrip line or a grounded coplanar line without using the connector. In addition, the attenuation units 60-1, 60-2, . . . , and 60-*n* may be constituted by resistors by manufacturing a thin film resistor in the middle of the microstrip line or the grounded coplanar line, and may operate as reflected wave blocking units. Meanwhile, in a case where the attenuation units are formed of the thin film resistor, transmission characteristics from the input terminal 10 of the divider 100 to each of the output terminals 50-1, 50-2, . . . , and 50-*n*** may be measured, and the thin film resistor may be trimmed through, for example, laser trimming, thereby further suppressing a difference in signal level between outputs from the respective output terminals. In addition, in a case of fixed attenuators, sorted products may be combined with each other, thereby further suppressing a difference in signal level between outputs from the respective output terminals.

Figure 4A:
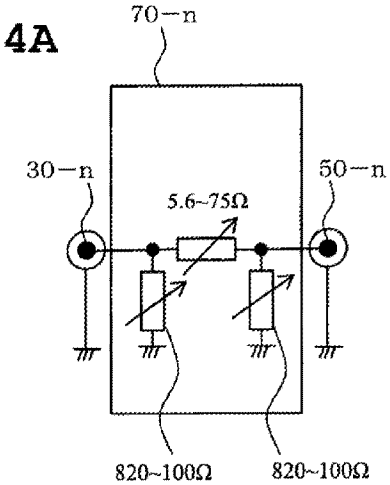
FIGS. 4A and 4B are schematic block diagrams illustrating a configuration example of an attenuation amount adjustment unit according to the invention.
Figure 4B:
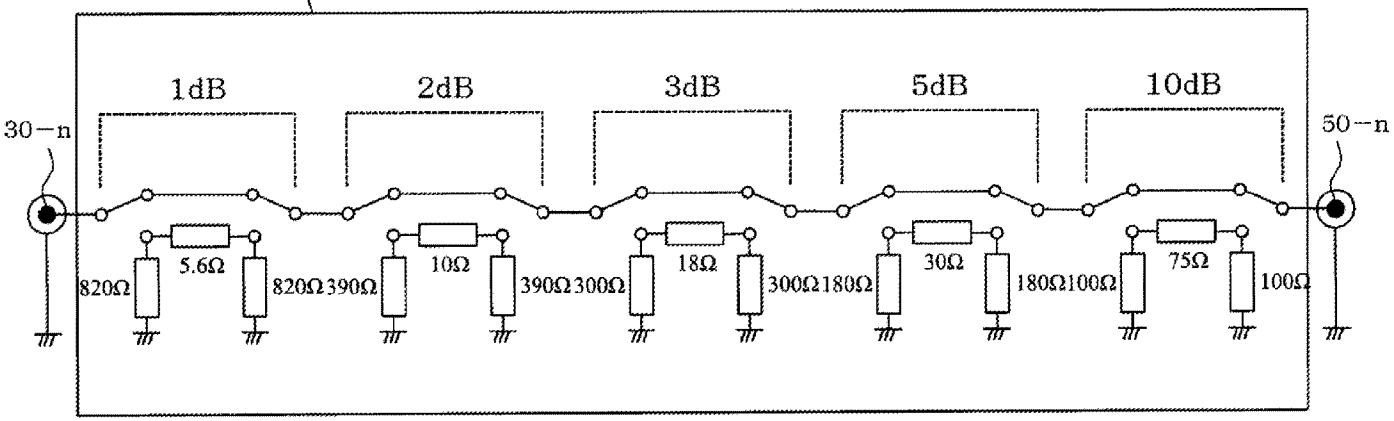

Further, the plurality of attenuation units 60-1, 60-2, . . . , and **60-*n* may be configured not only as fixed attenuators but also as the attenuation amount adjustment units 70-1, 70-2, . . . , and 70-*n* which are capable of changing the amount of attenuation by the changeover of a combination of a plurality of variable attenuators each of which is illustrated in FIG. 4A or a plurality of fixed attenuators each of which is illustrated in FIG. 4B and which are capable of setting the amount of attenuation to any value. The attenuators illustrated in FIGS. 4A and 4**B are examples of n-type attenuators, but can be similarly configured as T-type attenuators.

Figure 5:
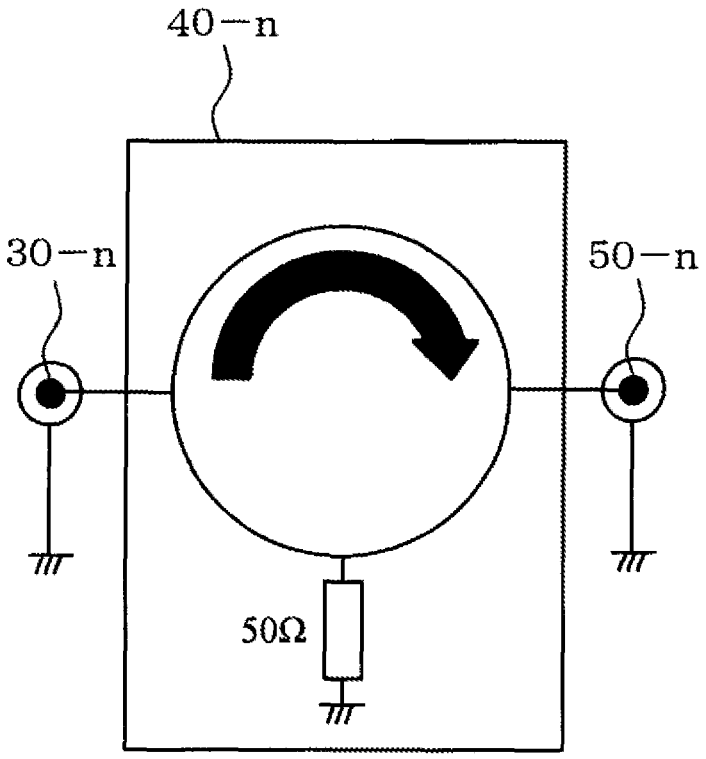
FIG. 5 is a schematic block diagram illustrating a configuration example of an isolator according to the invention.

In addition, the plurality of reflected wave blocking units 40-1, 40-2, . . . , and **40-*n* to be used may be isolators that transmit only a unidirectional signal directed toward the plurality of output terminals 50-1, 50-2, . . . , and 50-*n* from the distribution unit 20. An isolator illustrated in FIG. 5 transmits signals from the plurality of distribution unit outputs 30-1, 30-2, . . . , and 30-*n* to the plurality of output terminals 50-1, 50-2, . . . , and 50-*n* with a low loss, but absorbs signals from the plurality of output terminals 50-1, 50-2, . . . , and 50-*n* to the plurality of distribution unit outputs 30-1, 30-2, . . . , and 30-*n*** with a termination resistance of 50Ω. Meanwhile, in general, the isolation of the isolator is approximately 20 dB, and the isolator effectively operates as the reflected wave blocking unit of the invention.

The output terminals 50-1, 50-2, . . . , and **50-*n* are connected to the plurality of reflected wave blocking units 40-1, 40-2, . . . , and 40-*n*, respectively. A connector having excellent high frequency characteristics is preferably used as each of the output terminals 50-1, 50-2, . . . , and 50-*n***, and is a known high frequency coaxial connector such as an N-type or SMA-type connector.

An example of the operation of the divider 100 of this example will be described with reference to FIG. 1. A high frequency signal from the input terminal 10 is input to the divider 100, and it is assumed that an object to be measured, not shown in the drawing, is connected to, for example, two ports of the output terminals 50-1 and 50-2. In addition, the amount of attenuation of the attenuation units 40-1 and 40-2 is set to, for example, 3 dB. For example, in a case where input impedance of the object to be measured which is connected to the output terminal 50-1 is deviated from 50Ω, the unconformity of the impedance occurs, thereby generating reflected waves. The generated reflected waves are directed toward the attenuation unit 40-1 from the output terminal 50-1, and are attenuated by 3 dB. The attenuated reflected waves are directed toward the distribution unit output 30-1, pass through the distribution unit 20, and are directed toward the distribution unit output 30-2, thereby being attenuated by dB by the attenuation unit 40-2. Therefore, the reflected waves are attenuated by a total of 6 dB. In general, isolation of a plurality of outputs obtained by the distribution is approximately 20 dB. However, since the reflected waves are attenuated by a total of 6 dB, isolation by the divider 100 is improved up to 26 dB.

Figure 6:
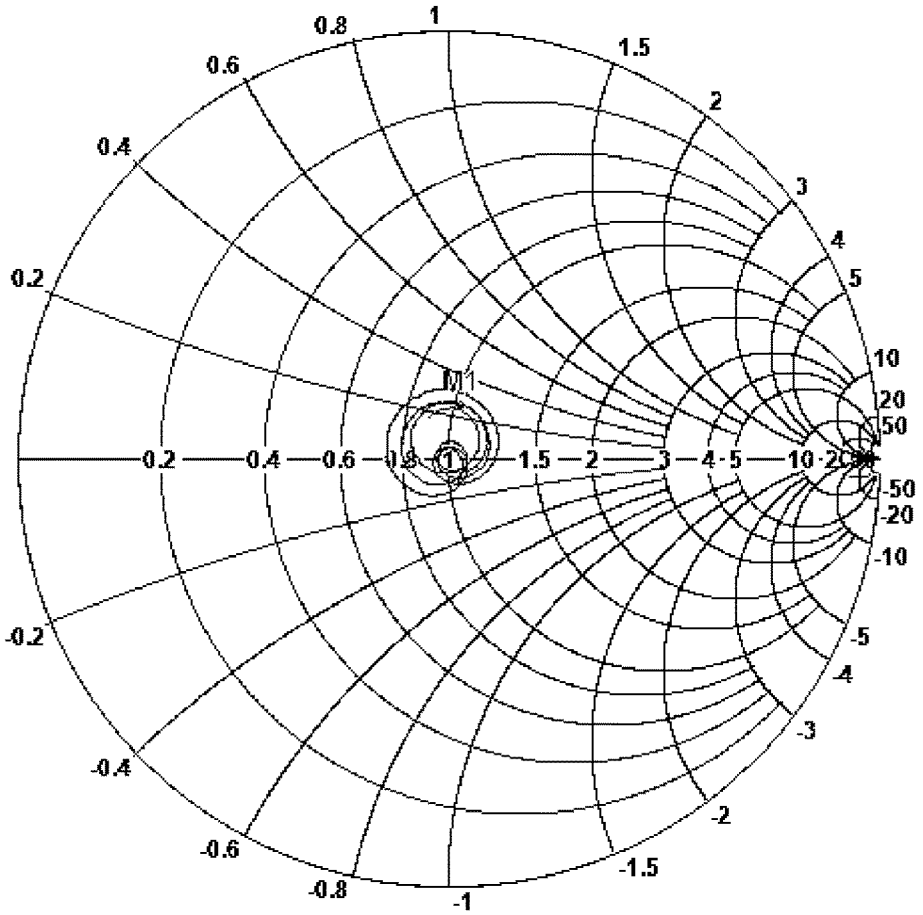
FIG. 6 is a Smith chart of characteristic impedance seen from an input terminal side when all output terminals of a distribution unit of the related art having reflected wave blocking units not being connected thereto are terminated.
Figure 7:
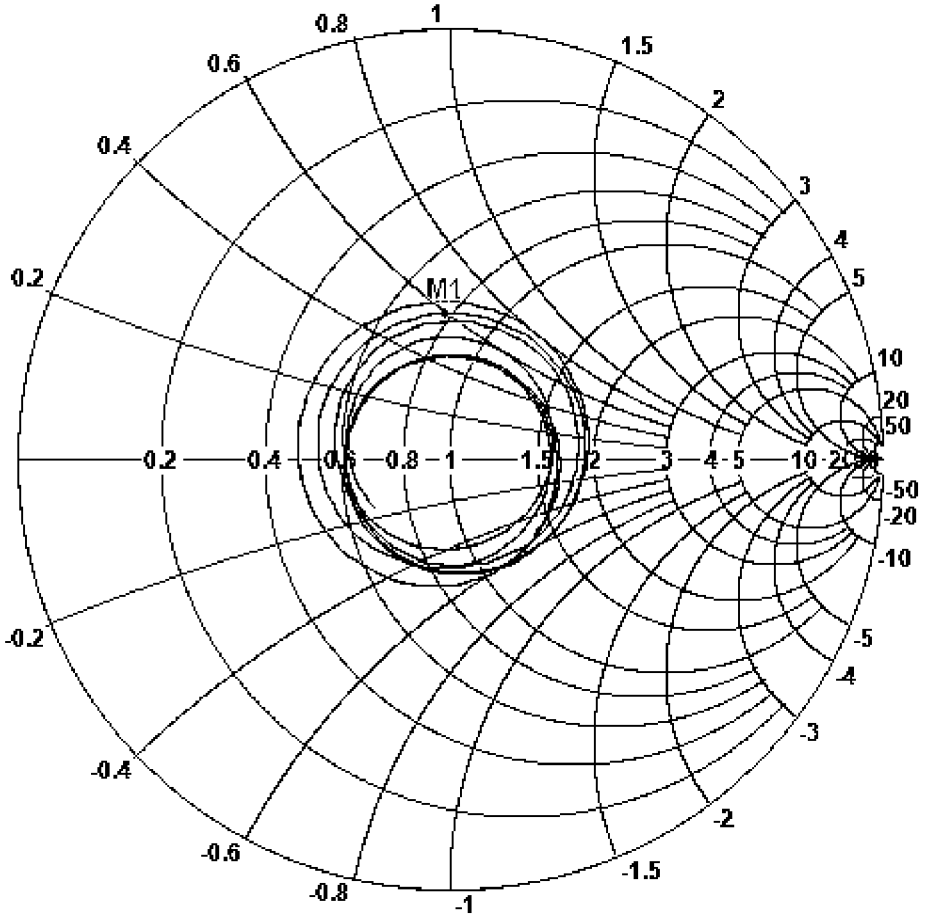
FIG. 7 is a Smith chart of characteristic impedance seen from the input terminal side when one of the output terminals of the distribution unit of the related art having reflected wave blocking units not being connected thereto is opened and the remaining output terminals are terminated.

Next, reference will be made to FIGS. 6 to 9 to describe comparison between the distribution unit 20 of the related art when the impedance of the output terminals 30-1, 30-2, . . . , and **30-*n* is disturbed and the divider 100 of the invention. Meanwhile, here, a case where the output terminals are constituted by four ports will be described. FIG. 6 is a Smith chart of characteristic impedance which is seen from the input terminal 10 side when all of the output terminals 30-1, 30-2, . . . , and 30-4 of the distribution unit 20 of the related art having the reflected wave blocking units 40-1, 40-2, . . . , and 40-4 not being connected thereto are terminated. FIG. 7 is a Smith chart of characteristic impedance which is seen from the input terminal 10 side when one of the output terminals 30-1, 30-2, . . . , and 30-4 of the distribution unit 20 of the related art having the reflected wave blocking units 40-1, 40-2, . . . , and 40-4 not being connected thereto is opened and the remaining three output terminals are terminated. It can be seen from FIGS. 6 and 7 that characteristic impedance seen from the input terminal 10 side is more significantly deviated from 50Ω than when all of the output terminals 30-1, 30-2, . . . , and 30-4** are terminated.

Figure 8:
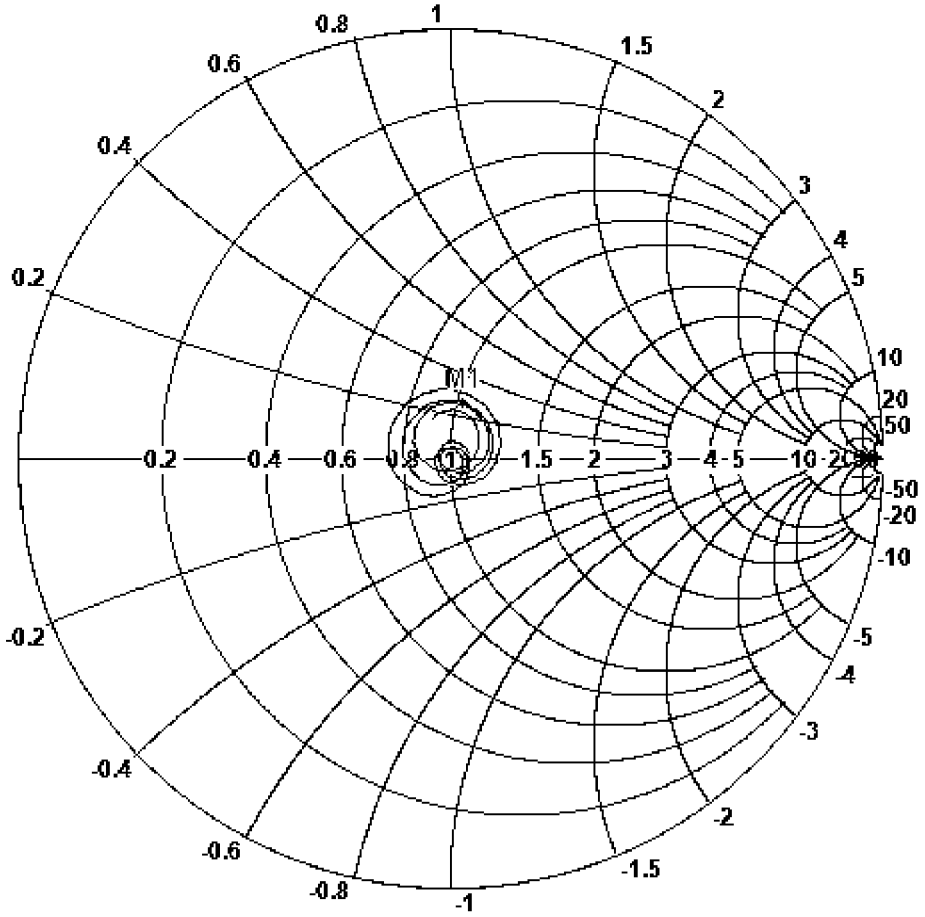
FIG. 8 is a Smith chart of characteristic impedance seen from the input terminal side when all output terminals of a divider according to the invention having reflected wave blocking units connected thereto are terminated.
Figure 9:
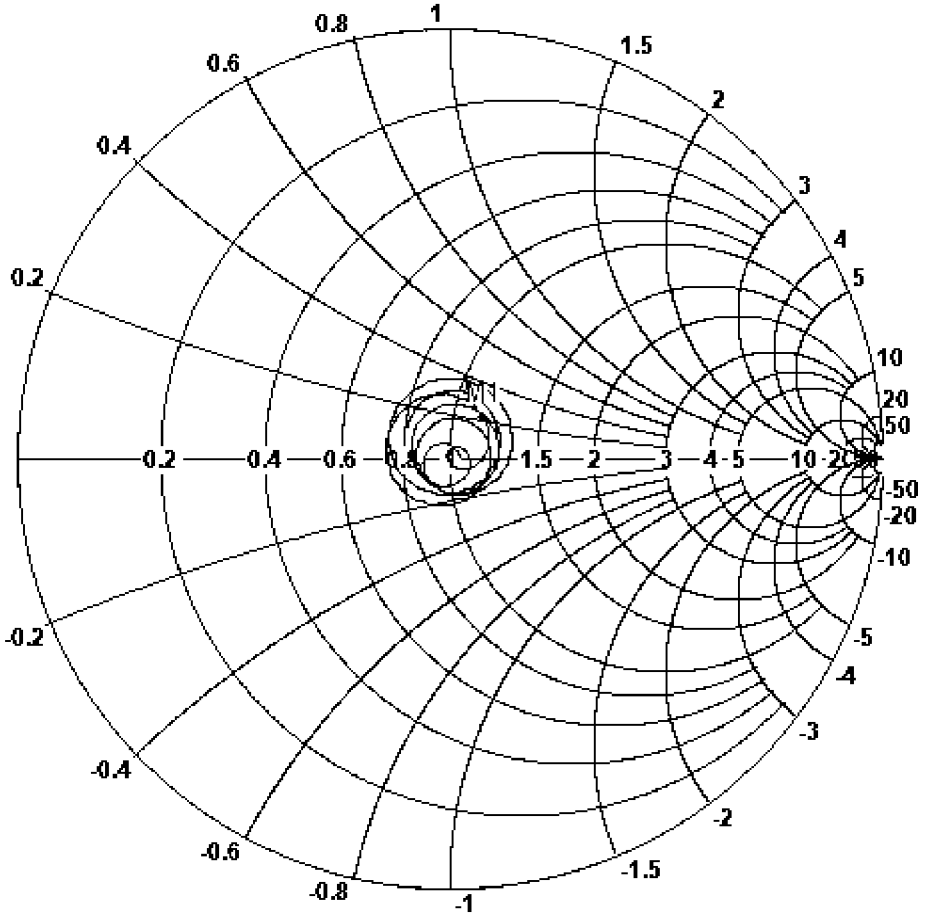
FIG. 9 is a Smith chart of characteristic impedance seen from the input terminal side when one of the output terminals of the divider according to the invention having the reflected wave blocking units connected thereto is opened and the remaining output terminals are terminated.

FIG. 8 is a Smith chart of characteristic impedance seen from the input terminal 10 when all of the output terminals 50-1, 50-2, . . . , and 50-4 of the divider 100 according to the invention having the reflected wave blocking units 40-1, 40-2, . . . , and 40-4 connected thereto are terminated. FIG. 9 is a Smith chart of characteristic impedance seen from the input terminal 10 side when one of the output terminals 50-1, 50-2, . . . , and 50-4 of the divider 100 according to the invention having the reflected wave blocking units 40-1, 40-2, . . . , and 40-4 connected thereto is opened and the remaining output terminals are terminated. It can be seen from FIGS. 8 and 9 that characteristic impedance seen from the input terminal 10 side is not less significantly deviated from 50Ω than when all of the output terminals 30-1, 30-2, . . . , and 30-4 are terminated and the deviation of impedance is sufficiently suppressed.

In addition, as described above, the distribution operation by the divider 100 is performed in a conformity state by the reflected waves being attenuated by a total of 6 dB, thereby reducing a difference in signal level between a plurality of outputs by the divider 100.

Figure 10:
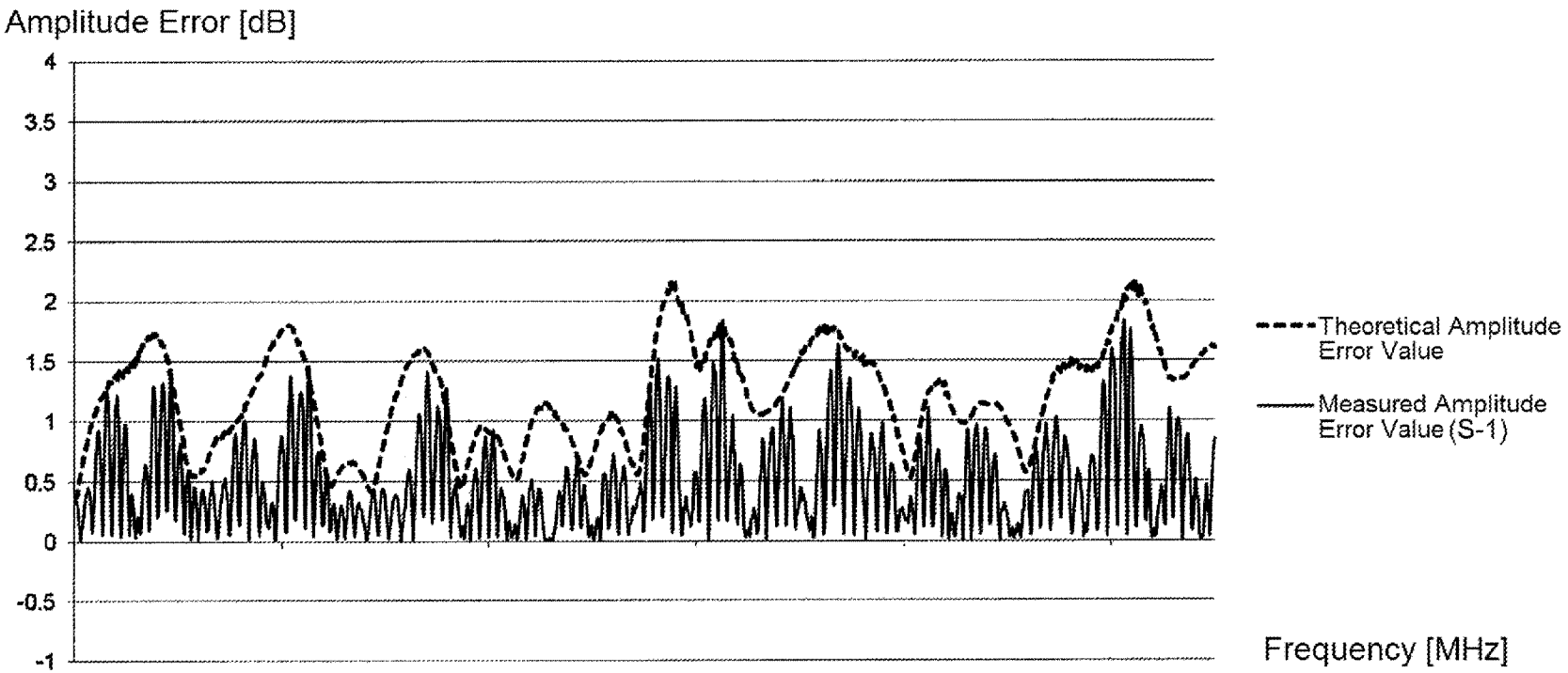
FIG. 10 is a diagram illustrating amplitude differences (amplitude errors) of S21 data between the output terminal of the distribution unit of the related art which is not terminated and the input terminal when the output terminals having reflected wave blocking units not being connected thereto are terminated, and S21 data when all of the terminated output terminals are opened.
Figure 11:
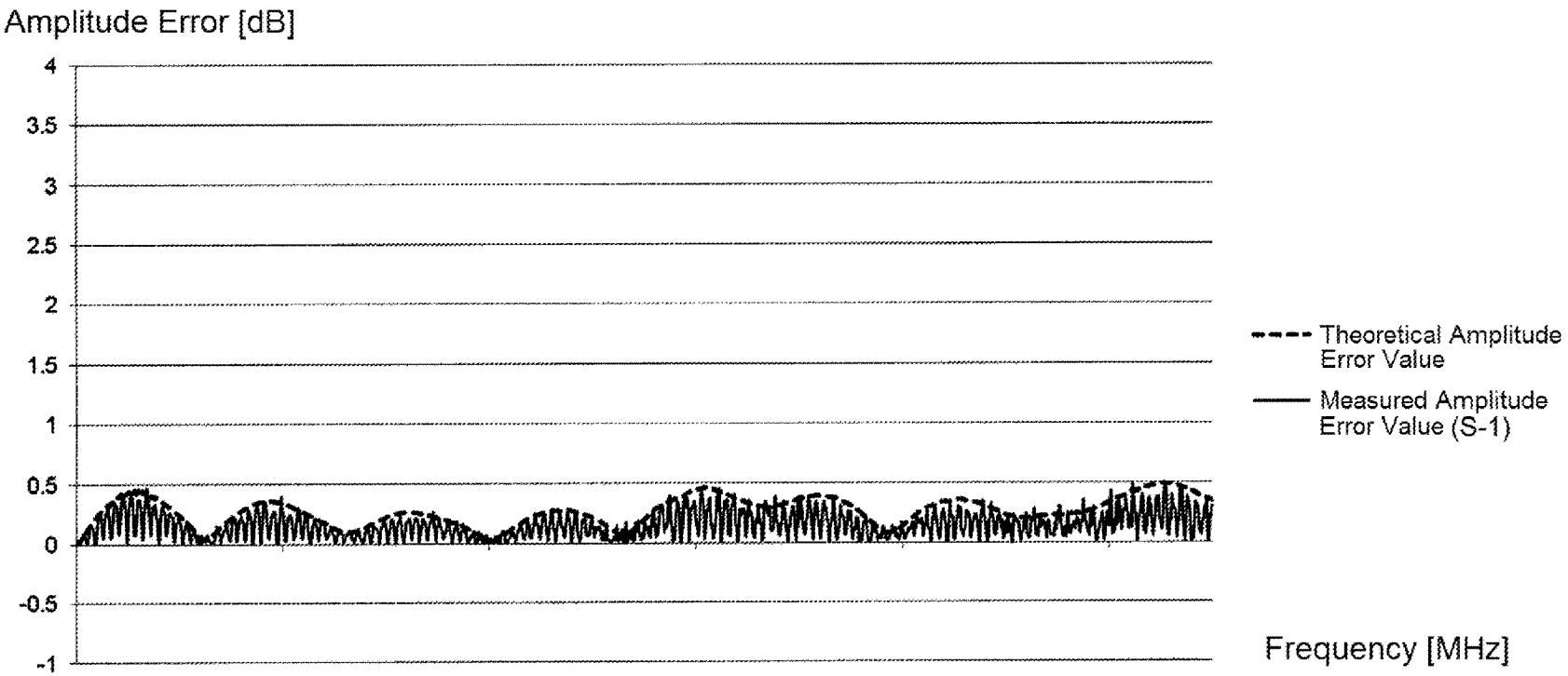
FIG. 11 is a diagram illustrating amplitude differences (amplitude errors) of S21 data between the output terminal of a divider according to the invention which is not terminated and the input terminal when the output terminals having reflected wave blocking units connected thereto are terminated, and S21 data when all of the terminated output terminals are opened.
Figure 12:
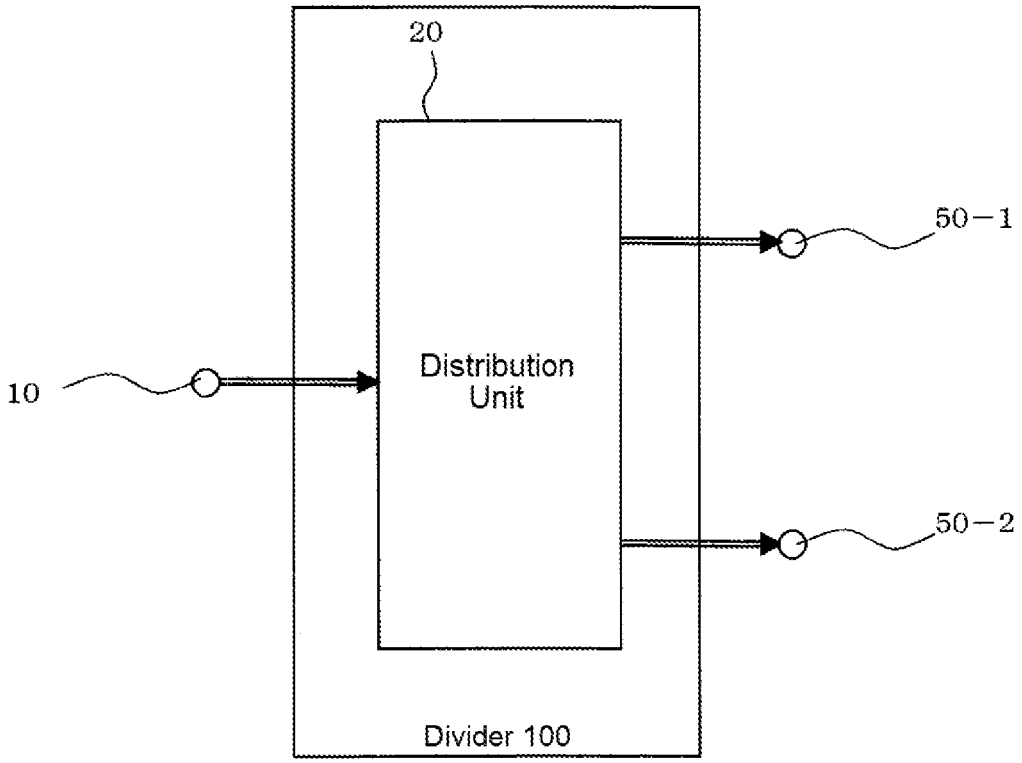
FIG. 12 is a schematic block diagram illustrating a configuration example of a divider of the related art.

Next, reference will be made to FIGS. 10 and 11 to describe comparison between the distribution unit 20 of the related art when one of the output terminals 30-1, 30-2, . . . , and **30-*n* is opened and the divider 100 according to the invention. Meanwhile, here, a case where the output terminals are constituted by four ports will be described. FIG. 10 is a diagram illustrating amplitude differences (amplitude errors) of S21 data between the output terminal 30-1 which is not terminated among the output terminals 30-1, 30-2, . . . , and 30-4 of the distribution unit 20 of the related art, and the input terminal 10 when three output terminals 30-2, 30-3, and 30-4 having the reflected wave suppression units 40-1, 40-2, . . . , and 40-4 not being connected thereto are terminated, and S21 data when all of the terminated output terminals 30-2, 30-3, and 30-4 are opened. FIG. 11 is a diagram illustrating amplitude differences (amplitude errors) of S21 data between the output terminal 50-1 which is not terminated among the output terminals 50-1, 50-2, 50-3, and 50-4 of the divider 100 according to the invention, and the input terminal 10 when three output terminals 50-2, 50-3, and 50-4, having the reflected wave suppression units 40-1, 40-2, . . . , and 40-4 connected thereto, are terminated, and S21 data when all of the terminated output terminals 50-2, 50-3, and 50-4 are opened. An amplitude error of a maximum of 2 dB or greater occurs in FIG. 10, while an amplitude error is suppressed to a maximum of 0.5 dB or less in FIG. 11. Thus, it can be seen that a difference in signal level between outputs of the divider 100** can be extremely reduced.

Further, according to the invention, impedance conformity seen from an output side of a signal generator provided at a front stage of a signal generation system is sufficiently secured, and a problem caused by reflected waves is solved.

In addition, in a case where the plurality of attenuation units 60-1, 60-2, . . . , and **60-*n* are configured to be capable of changing the amount of attenuation by the changeover of a combination of a plurality of variable attenuators or a plurality of fixed attenuators and setting the amount of attenuation to any value, the amount of attenuation can be set to any value when a high frequency signal from the signal generator 200 is applied to an object to be measured, not shown in the drawing, through the divider 100**. For example, the amount of attenuation is set to any value so as to set a signal level at which the object to be measured, not shown in the drawing, can receive a signal. For this reason, it is possible to set the amount of attenuation for performing trade-off between influence on measurement due to excessive attenuation of the high frequency signal and an effect of reducing reflected waves and to optimize measurement conditions.

Second Embodiment

Next, another configuration of the divider 100 according to the invention will be described with reference to FIG. 2.

Figure 2:
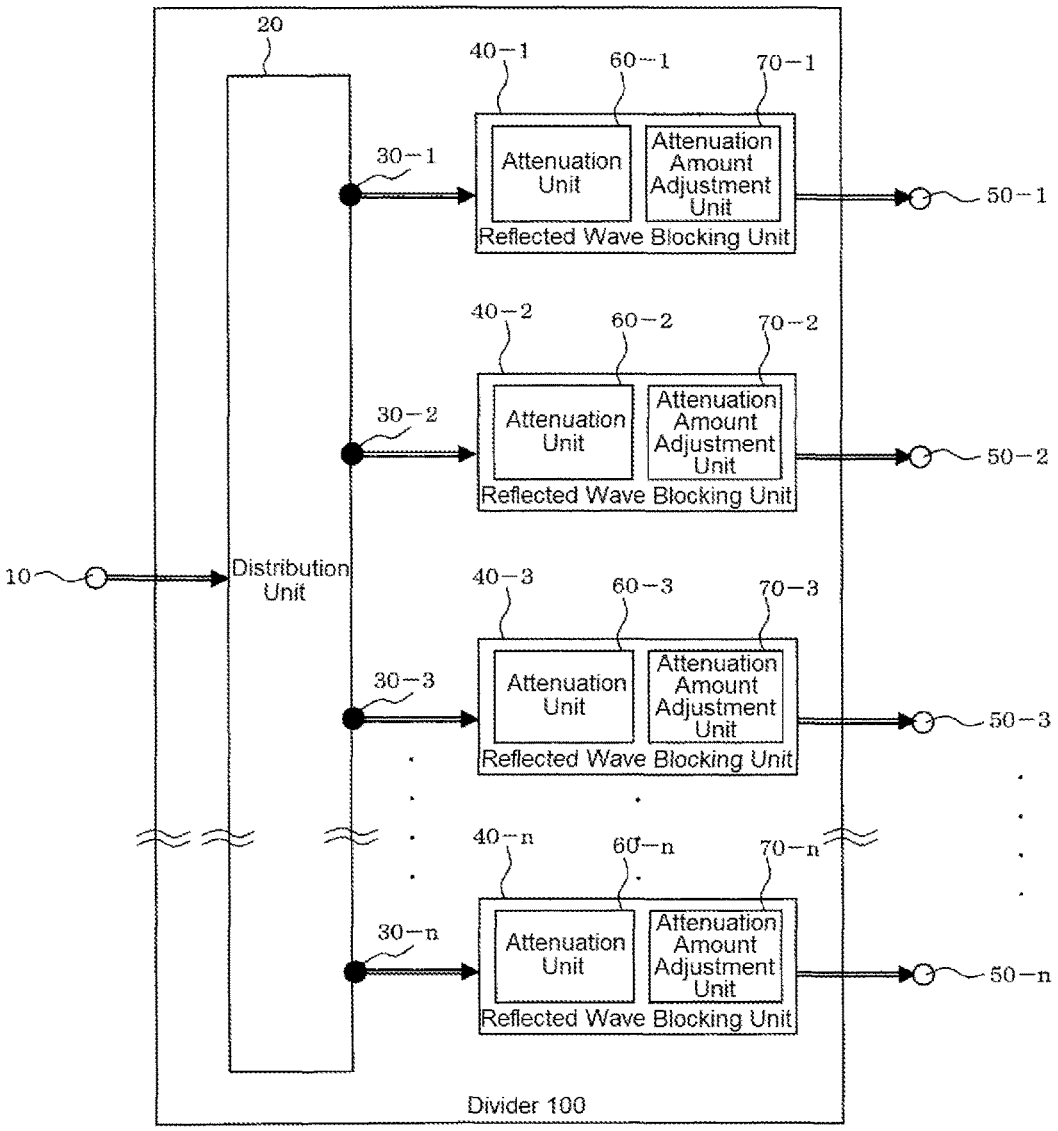
FIG. 2 is a schematic block diagram illustrating another configuration example of the divider according to the invention.

As illustrated in FIG. 2, this embodiment is the same as the first embodiment except that output terminals 50-1, 50-2, 50-3, . . . , and **50-*n*** are constituted by n ports, and thus a description thereof will be omitted. In this manner, the number of ports constituting the output terminals is not limited to two or four, and may be n.

Third Embodiment

Next, the operation of a signal generation system 500 using the divider 100 described above will be described with reference to FIG. 3.

In the signal generation system 500 of this example, the signal generator 200 generating, for example, a high frequency signal at any frequency and any signal level of any modulation system is connected to the input terminal 10 of the divider 100.

Figure 3:
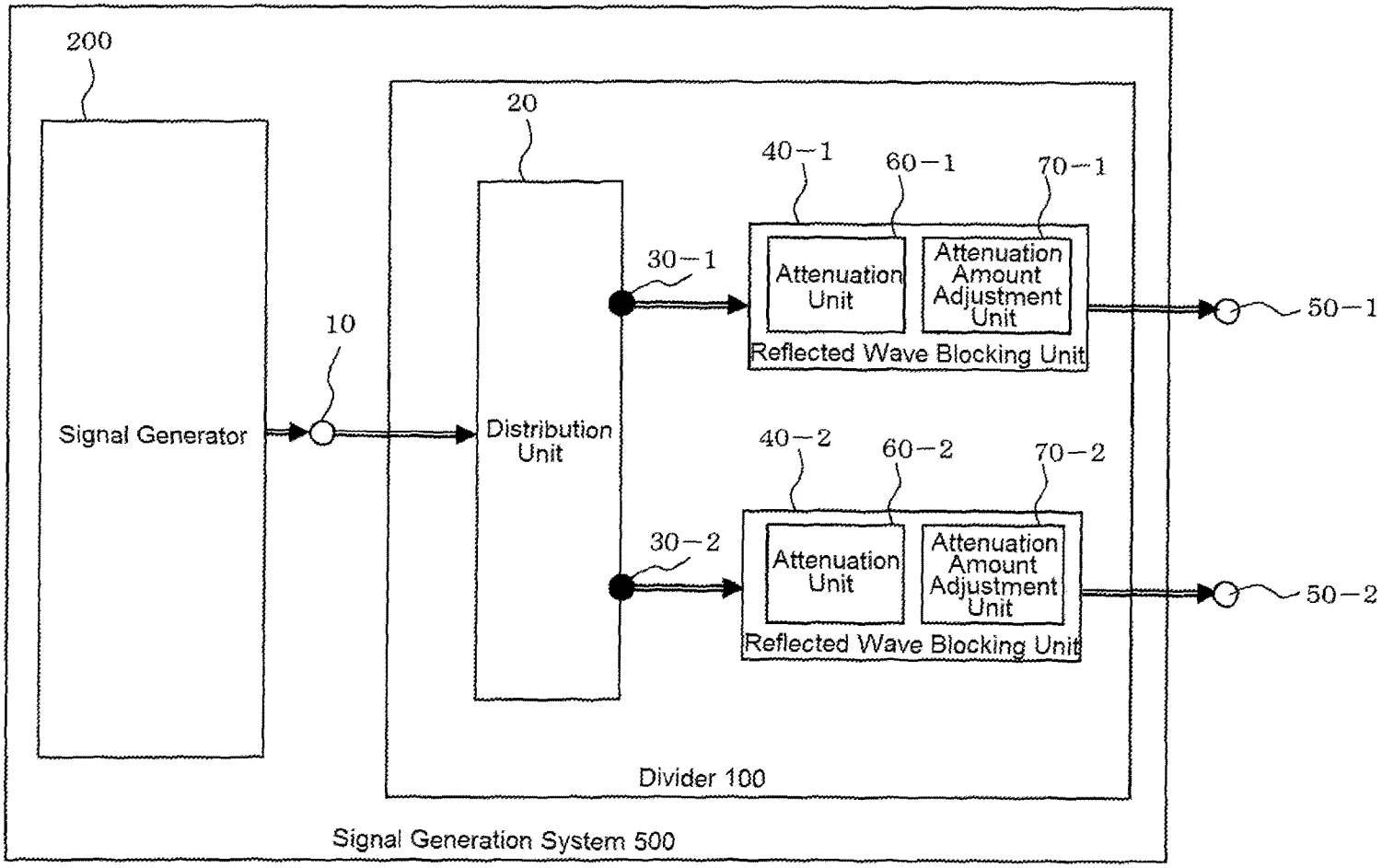
FIG. 3 is a schematic block diagram illustrating a configuration example of a signal generation system according to the invention.

The operation of the divider 100 is the same as that in the first embodiment, and thus a description thereof will be omitted. Meanwhile, in the signal generation system 500, the number of ports constituting the output terminals is not limited to two as illustrated in FIG. 3, and may be n as illustrated in FIG. 2.

DESCRIPTION OF REFERENCE NUMERALS AND SIGNS

10 Input Terminal
20 Distribution Unit
30-1, 30-2, . . . , and **30-*n*** Distribution Unit Output
40-1, 40-2, . . . , and **40-*n*** Reflected Wave Blocking Unit
50-1, 50-2, . . . , and **50-*n*** Output Terminal
60-1, 60-2, . . . , and **60-*n*** Attenuation Unit
70-1, 70-2, . . . , and **70-*n*** Attenuation Amount Adjustment Unit
100 Divider
200 Signal Generator
500 Signal Generation System

What is claimed is:

1. A divider comprising:
an input terminal;
a plurality of output terminals;
a divide unit that divides a high frequency signal input to the input terminal and outputs the divided signals; and
a plurality of reflected wave blocking units that are respectively connected to a plurality of divide unit outputs and are configured to attenuate reflected waves reflected outside of the plurality of output terminals, each of the reflected wave blocking units being configured to attenuate the reflected waves by 3 dB-10 dB,
wherein the reflected waves are components of the input high frequency signal or the divided signals resulting from defective terminal contacts or improper impedance matching,
wherein the divide unit includes the plurality of divide unit outputs and outputs the divided signals from the plurality of divide unit outputs, and
wherein outputs from the plurality of reflected wave blocking units are output from the plurality of output terminals.

2. The divider according to claim 1, wherein the plurality of reflected wave blocking units respectively include attenuation units that attenuate a reflected signal.

3. The divider according to claim 2, further comprising:
attenuation amount adjustment units that are disposed between the plurality of divider unit outputs and the plurality of output terminals and adjust amounts of attenuation of the attenuation units.

4. A signal generation system comprising:
the divider according to claim 2; and
a signal generator that generates the high frequency signal,
wherein the high frequency signal generated by the signal generator is input to the input terminal.

5. A signal generation system comprising:
the divider according to claim 3; and
a signal generator that generates the high frequency signal,
wherein the high frequency signal generated by the signal generator is input to the input terminal.

6. The divider according to claim 1, wherein each of the plurality of reflected wave blocking units includes an isolator that transmits only a unidirectional signal directed toward the plurality of output terminals from the divide unit.

7. A signal generation system comprising:
the divider according to claim 6; and
a signal generator that generates the high frequency signal,
wherein the high frequency signal generated by the signal generator is input to the input terminal.

8. A signal generation system comprising:
the divider according to claim 1; and
a signal generator that generates the high frequency signal,
wherein the high frequency signal generated by the signal generator is input to the input terminal.

9. The divider according to claim 1, wherein the plurality of reflected wave blocking units each comprise a it-type or T-type attenuator.

10. The divider according to claim 1, wherein the plurality of reflected wave blocking units each comprise a resistor network configured to attenuate the reflected waves.

* * * * *